United States Patent [19]

Toda et al.

[11] 4,406,859

[45] Sep. 27, 1983

[54] ANTICORROSION COPPER ALLOYS

[75] Inventors: Yoshihisa Toda, Ashiya; Hiroshi Yamamoto; Kenzi Sata, both of Amagasaki, all of Japan

[73] Assignee: The Furukawa Electric Company, Ltd., Tokyo, Japan

[21] Appl. No.: 440,526

[22] Filed: Nov. 10, 1982

[30] Foreign Application Priority Data

Nov. 10, 1981 [JP] Japan ..... 56-180029

[51] Int. Cl.[3] ..... C22B 25/00

[52] U.S. Cl. ..... 420/487; 420/497

[58] Field of Search ..... 420/485, 487, 489, 497; 148/435

[56] References Cited

U.S. PATENT DOCUMENTS

| | | | |
|---|---|---|---|
| 2,074,604 | 3/1937 | Bolton et al. | 420/487 |
| 2,215,905 | 9/1940 | Kihlgren | 420/487 |
| 3,728,106 | 4/1973 | Badia et al. | 420/487 |
| 4,034,954 | 7/1977 | Scherbner | 420/487 |

FOREIGN PATENT DOCUMENTS

| | | | |
|---|---|---|---|
| 473750 | 5/1951 | Canada | 420/487 |
| 57-43950 | 3/1982 | Japan | 420/487 |
| 1052622 | 12/1966 | United Kingdom | 420/487 |

OTHER PUBLICATIONS

"Copper-Nickel Alloy In-838", Date Unknown, International Nickel Company, Inc.

"Why Copper-Nickel Alloys for Desalination", 1966, International Nickel Company, Inc.

"Corrosion Resisting Characteristics of Iron Modified 90:10 Cupro-Nickel Alloy", 1952, Corrosion, vol. 8, pp. 259-277.

"Heat Treatment and Corrosion Resistance of Cr-Modified Cu-Ni" Nov. 23, 1976, International Nickel Co., Inc., No. 949-OP.

"Effect of Alloying and Residual Elements on Strength and Hot Ductility of Cast Cupro-Nickel", J. Metals, Mar. 1978, pp. 20-25.

Pearson, C., "Role of Iron in the Inhibition of Corrosion of Marine Heat Exchangers-A Review", Br. Corros. J., 1972, vol. 7, pp. 61-68.

Abstract of "1982 Annual Book of ASTM Standards", pp. 1245, 1248, 1249.

D. B. Anderson et al., "Chromium Modified Copper-Nickel Alloys for Improved Seawater Impingement Resistance", Transactions of the ASME, Apr. 1973, pp. 132-135.

*Primary Examiner*—Peter K. Skiff

*Attorney, Agent, or Firm*—Armstrong, Nikaido, Marmelstein & Kubovcik

[57] ABSTRACT

Anticorrosion copper alloy essentially consisting of 4.5-32 wt % of Ni, 0.3-2.5 wt % of Fe, one or more elements selected from 0.01-1.0 wt % of In, 0.003-0.2 wt % of Pd and 0.003-0.1 wt % of Pt, and the balance of Cu and normal impurities. Further, an anticorrosion copper alloy essentially consisting of 4.5-22 wt % of Ni, 1.3-2.5 wt % of Fe, one or more elements selected from 0.1-1.0 wt % of In, 0.01-0.2 wt % of Pd and 0.01-0.1 wt % of Pt, and the balance of Cu and normal impurities; and said Fe being kept in a state of solid solution in a matrix of said copper alloy.

10 Claims, 1 Drawing Figure

ANTICORROSION COPPER ALLOYS

DETAILED DESCRIPTION OF THE INVENTION

Figure 1:
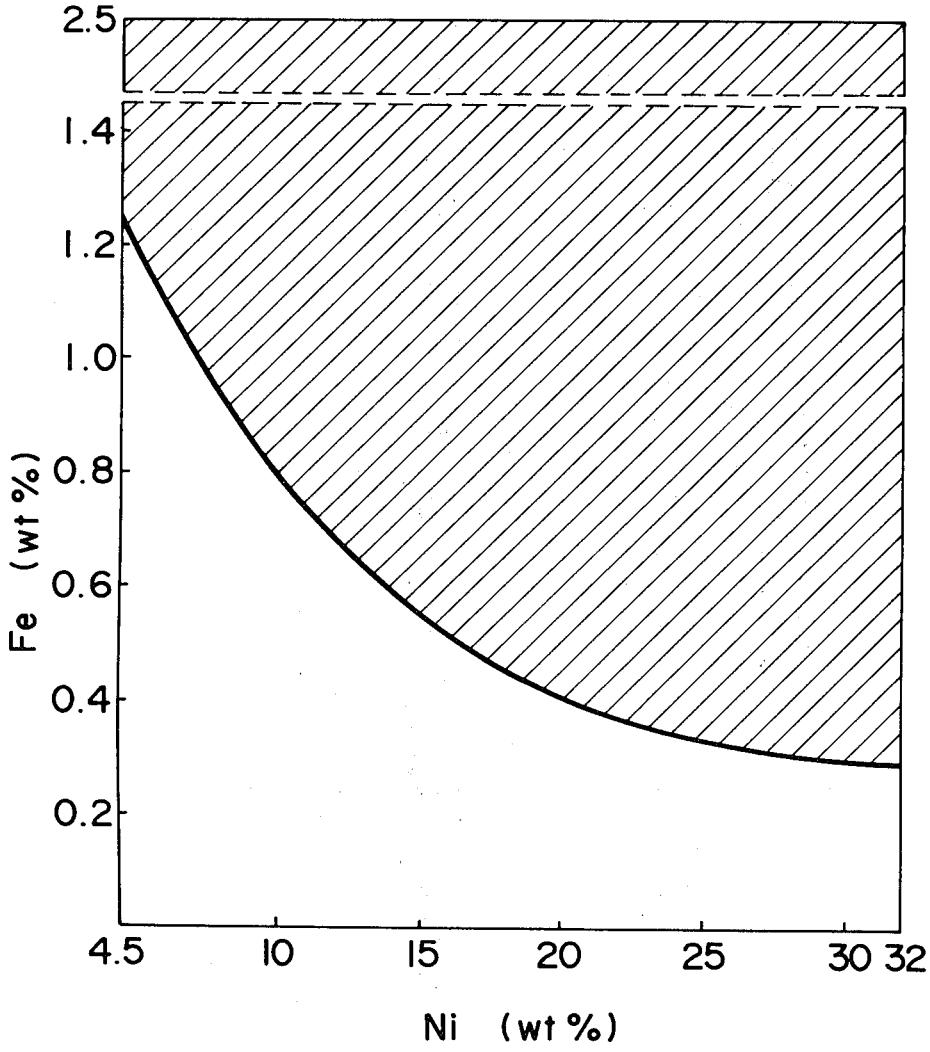
FIG. 1 shows the amount of Ni wt % in the axis of abscissa and the amount of Fe wt % in the axis of ordinate, and the relation between the amounts of Ni and Fe being plotted after the examination of many data.

The present invention relates to improvement of the Cu-Ni-Fe alloys (cupro-nickel) known as the anticorrosion copper alloy and particularly improvement of their anti-erosion against sea water.

The Cu-Ni-Fe alloy has been known as having a proper anticorrosion and widely used so far to heat exchangers, etc. using sea water. However, the alloy has been insufficient in the anti-erosion against sea water, that is, anti-erosion against sea water of a high flow speed.

Some improvement methods for the problem have been proposed. For example, there is a known method of enhancing the anti-erosion against the sea water by keeping the iron contained in the alloy in a state of solid solution.

In this case, in order to keep the iron contained in the alloy in the state of solid solution, it is necessary to quench by water from high temperatures enough forth solution of iron for the purpose of avoiding a precipitation of the iron. Therefore the size and shape of the product are limited due to the heat treatment mentioned above, for example, large product with a thick wall thickness can not be quenched, and, in some cases, the improvement of the product can not be expected. Further, C70600 alloy of A.S.T.M., which contains Ni in a small amount of about 10 wt %, is not sufficient in the anti-erosion against sea water even if Fe is kept in the state of solid solution by quenching.

In case of C72200 alloy of A.S.T.M., there is a known method in which the Cu-Ni-Fe alloy is given Cr to enhance the anti-erosion against sea water. Since Cr kept in the state of solid solution is effective for anti-erosion in this case, this alloy also requires the heat treatment as in the case of Fe and conseqeuntly limits the size and shape of products made of it. In addition, the alloy requires 15 wt % or more of Ni and 0.3 wt % or more of Cr in order to obtain the aforementioned property. Therefore, the C72200 alloy is inferior in workabiliy to the C70600 alloy since it has a higher Ni content than the C70600 alloy (about 10% Ni) and contains Cr.

In the case of C71640 alloy of A.S.T.M., it is known that the alloy is enhanced in the anti-erosion againt the sea water by increasing the amount of Ni to about 30 wt % and the amount of Fe and Mn respectively to about 2 wt %. However, the alloy is considerably inferior in the workability to the C70600 alloy since it contains more Ni and Fe than the C70600 alloy. Further, the C71640 alloy is inferior in the workability to the C71500 alloy of A.S.T.M. containing similar amount of Ni since it contains more Fe than the latter.

It is the primary oboject of the present invention to provide an anticorrosion copper alloy which shows a good workability and an excellent anti-erosion without requriement of the heat treatment mentioned above.

It is another object of the present invention to provide an anticorrosion copper alloy which shows a far more excellent anti-erosion than the conventional alloy when the Fe is kept in the state of solid solution by the aformentioned heat treatment.

The alloy of this invention is applied to all parts which are used in contact with the water which erodes Cu-Ni-Fe alloys usually sea water. It is usable also in contact with any other salt water or filthy water much as concentrated sea water, river water, lake water, rain water, spring water, etc.

To outline of this invention, while the Cu-Ni alloys are known to be improved in anti-erosion by addition of a small amount of Fe, the alloys of this invention are given a marked improvement in anti-erosion not attainable by addition of Fe alone, by simultaneous addition of Fe and one or more elements selected from In, Pd and Pt.

In the alloy of this invention, the composition of the alloy should be limited as follows.

The alloy of this invention essentially consists of 4.5–32 wt % of Ni and 0.3–2.5 wt % of Fe shown as coordinates within the shaded area of FIG. 1; one or more elements selected from 0.01–1.0 wt % of In, 0.003–0.2 wt % of Pd and 0.003–0.1 wt % of Pt; and the remainder, Cu and normal impurities. Still more, not more than 1.0 wt % of Mn may be contained therein. (Hereinafter the symbol "%", denotes, "% by weight".)

Further, the alloy of this invention is preferably consisting of 7.5–15 wt % of Ni, 1.0–2.0% of Fe, one or more elements selected from 0.1–1.0% of In, 0.01–0.2% of Pd and 0.01–0.1% of Pt, and the remainder, Cu and normal impurities. Still more, not more than 1.0% of Mn may be contained therein.

For the high anti-erosion requirment as in the case of touching the concentrated sea water and the sea water containing sand, the alloys of this invention essentilly consist of 28–32% of Ni, 0.4–1.0% of Fe, one or more elements selected from 0.1–1.0% of In, 0.01–0.2% of Pd and 0.01–0.1% of Pt, and the remainder Cu and normal impurities. Still more, not more than 1.0% of Mn may be contained therein.

When the alloys of this invention are applied to the parts materials which are formed in a shape of enabling Fe in a state of solid solution by quenching, the alloys of this invention are so arranged as to have Fe contained in a state of solid solution and essentially consist of 4.5–22% of Ni, preferably 7.5–15% of Ni, 1.3–2.5% of Fe, one or more elements selected from 0.1–1.0% of In, 0.01–0.2% of Pd and 0.01–0.1% of Pt, and the balance of Cu and normal impurities. Still more, not more than 1.0% of Mn may be contained therein.

The compositions of the invented alloys are defined as described above on the ground of the following reasons.

The amount of Ni can be reduced to about 4.5% but preferably 7.5% or more. While the anti-erosion of the alloy is enhanced with increase in the amount of Ni, its workability is slightly decreased and, therefore, if workability is deemed important, the amount of Ni is preferably reduced to 15% or less.

If a remarkable anti-erosion is necessary, the amount of Ni is preferably 28–32%. However, when the addition amount of Ni exceeds 32%, the anti-erosion of the alloy is not increased in proportion to the increase in the amount of Ni, and the addition of more than 32% of Ni is not preferable for reasons of cost. Further, the remarkable enhancement of the anti-erosion by the solution heat treatment to put Fe in a state of solid solution is limited to the case in which the amount of Ni is in the range of 4.5–22%, and the addition of more than 22% of Ni does not provide any remarkable effect of the heat treatment.

When the anti-erosion is remarkably enhanced by the addition of Fe and the simultaneous addition of one or more elements selected from In, Pd and Pt, the minimum amount of Fe depends on the amount of Ni and in all alloys of this invention, the amount of Fe must come under the values shown as coordinates within the shaded area of FIG. 1. In other words, when the amount of Ni is 4.5%, the amount of Fe must be at least 1.25% and when the amount of Ni is 32%, the amount of Fe must be at least 0.3%. It is preferable that, when the amount of Ni is 7.5–15%, the amount of Fe must be not less than 1.0% and when the amount of Fe is 28–32%, the amount of Fe is not less than 0.4%. In addition, in order to make the solution heat treatment of Fe effective in remarkable enhancement of anti-erosion, the amount of Fe must be not less than 1.3%. On the other hand, since the amount of Fe exceeding 2.5% causes a crevice corrosion, all alloys of this invention should have Fe in an amount of not more than 2.5% and preferably in 2.0% or less. Furthermore, when Ni is added in the amount of 28–32%, the addition of Fe in the amount of more than 1.0% deteriorates the workability of the alloy. Therefore, the amount of Fe is preferably not more than 1.0%. FIG. 1 shows the amount of Ni (%) on the axis of abscissas and the amount of Fe (%) on the axis of ordinates, the relation between the amounts of Ni and Fe being plotted after the examination of many data.

In respect of the amount of one or more elements selected from In, Pd and Pt, although 0.01% of In, 0.003% of Pd and 0.003% of Pt is effective in enhancing the anti-erosion of the alloy 0.1–1.0% of In, 0.01–0.2% of Pd and 0.01–0.1% of Pt are more preferable. Although these elements added enhance the anti-erosion remarkably in proportion to the amount of each element, the addition of these expensive metals in an amount beyond the upper limits cannot further enhance the anti-erosion and is disadvantageous in point of cost.

The amount of Mn in not more than 1.0% is based on the ground that the addition of Mn into the Cu-Ni-Fe alloys is known to improve the castability and the workabilty without deteriorating the anticorrosion and that the addition of Mn in the amount of not more than 1.0% to the invented alloys does not also deteriorate the anticorrosion.

Further, the alloys of this invention may contain impurities such as Sn, Pb, Zn, etc. held in the normal copper base metals and deoxidizer such as Ti, Zr, Al, Si, Mg, etc., and the total amount of these elements in less than 0.5% brings no disadvantages.

The examples of the invented alloys are described as follows.

Tables 1 and 2 indicate the alloys of this invention, the alloys other than the invented alloys and the conventional alloys which were subjected to the anticorrosion tests for the purpose of comparison. In order to obtain these alloys, an electrolytic copper and an electrolytic nickel were first melted in a magnesia crucible under air atmosphere, then added with various elements of a certain amount in a form of mother alloy, that is, Cu-Fe, Cu-In, Cu-Pd, Cu-Pt and Cu-Mn alloys and deoxidized. And these alloys thus obtained were cast into metal molds and obtained ingots were hot-rolled and then cold-rolled into plates having a thickness of 1 mm. These alloy plates were annealed from a temperature of 700° C., each composition of which being indicated in table 1 and those alloy plates subjected to quenching by water from a temperature of 900° C., each composition of which being indicated in Table 2. These alloy plates were subjected to an erosion test by the jet test apparatus of B.N.F.M.R.A. type with the result also shown in Tables 1 and 2.

The test was performed by a 3% NaCl solution which was applied to the test pieces with 8.5 m/sec of the flow speed with mixing 3% volume of air during the application of the solution, and for 30 days. The 8.5 m/sec of the flow speed is the solution applying speed which usually forms erosion on the conventional Cu-Ni-Fe alloys. The maximum depth and the weight loss per unit area due to the erosion were measured.

As apparent from Table 1, the alloys of this invention Nos. 1–29 being added with one or more members selected from In, Pd and Pt exhibit a prominent anti-erosion in the decrease of the corrosion depth and the weight loss in all cases of the amount of Ni in 5%, 10%, 20% and 30% when compared with the conventional alloy Nos. 37–40. In contrast, in all comparative examples for the alloy No. 30 being decreased in the amount of Ni, the alloy Nos. 31–32 being decreased in the amount of Fe, the alloy No. 33 being increased in the amount of Fe and the alloy Nos. 34–36 being decreased in the amount of one selected from In, Pd and Pt, in comparison with the composition of the invented alloys, the increase of the depth and weight loss due to erosion were perceived to thereby clarify a hindrance on the improvement of the anti-erosion.

As mentioned above, the invented alloys require no specific heat treatment, etc. to increase the anti-erosion and maintain the workability equal to that of the conventional Cu-Ni-Fe alloys since there is no difference in the components except the addition of a very small amount of one or more elements selected from In, Pd and Pt, when compared to those of the conventional Cu-Ni-Fe alloys.

Next, as seen from the results in Table 2 of the quenching by water from 900° C., the invented alloys containing Ni in the amount of 5%, 10% and 20% and the amount of Fe within the range of 1.3–2.5% result in decreasing the maximum depth and especially the weight loss considerably because of the Fe contained therein being put in the state of solid solution by quenching, in comparison with the invented alloys containing equal components in Table 1, thereby showing a prominent improvement on the anti-erosion. Further, in Table 2, the invented alloys containing Ni in the amount of 5%, 10% and 20% and the amount of Fe within the range of 1.3–2.5% exhibit a prominentlty excellent anti-erosion in comparison with the conventional alloy Nos. 56–59 subjected to the same heat treatment, and therefore the invented alloys are more superior in the improvement effect of the anti-erosion due to the heat treatment than the conventional alloys. Still more, in Table 2, the invented alloy Nos. 45, 51 and 53–55 containing the amount of Fe being in less than 1.3% and the amount of Ni being exceeding 22% make little difference in either the corrosion depth or the weight loss in comparison with the invented alloys Nos. 721, 25, 26 and 28 containing same components as in Table 1, and therefore it is learned that 4.5–22% of Ni and 1.3–2.5% of Fe should be selected in case the invented alloys are used with quenching. In the examples of Table 2, the quenching by water was employed, but any other methods which put Fe in the state of solid solution are to be employed.

As in the foregoing description, the alloys of this invention maintain the same workability as that of the conventional Cu-Ni-Fe alloys and exhibit a great improvement in anti-erosion by means of the heat treatment, and further have remarkable anti-erosion even if not subjected to the heat treatment, thereby confirming an excellent anti-erosion effect without any limitation on the size and shape of the products, in comparison with the conventional Cu-Ni-Fe alloys. Accordingly, the alloys of this invention show a prominent effect when they are applied to the heat exchangers and other component parts which form erosion in case of the conventional Cu-Ni-Fe alloys.

TABLE 1

| Alloy | No | Composition (wt %) Ni | Fe | In | Pd | Pt | Mn | Cu | Maximum corrosion depth(mm) | Weight loss (mg/cm2) |
|---|---|---|---|---|---|---|---|---|---|---|
| Invented alloy | 1 | 4.9 | 1.33 | 0.01 | — | — | — | Balance | 0.17 | 8.7 |
| " | 2 | 5.1 | 1.81 | 0.95 | — | — | 0.71 | " | 0.09 | 6.4 |
| " | 3 | 5.0 | 1.23 | — | 0.005 | — | 0.72 | " | 0.15 | 7.0 |
| " | 4 | 4.8 | 1.78 | — | 0.200 | — | — | " | 0.07 | 5.8 |
| " | 5 | 5.0 | 1.51 | — | — | 0.005 | — | " | 0.14 | 7.2 |
| " | 6 | 5.2 | 1.53 | 0.51 | 0.11 | 0.10 | 0.68 | " | 0.06 | 5.8 |
| " | 7 | 10.2 | 0.83 | 0.01 | — | — | 0.75 | " | 0.12 | 6.1 |
| " | 8 | 9.8 | 1.54 | 0.12 | — | — | — | " | 0.04 | 4.9 |
| " | 9 | 9.9 | 1.55 | 0.98 | — | — | 0.70 | " | <0.02 | 3.9 |
| " | 10 | 10.5 | 2.01 | 0.23 | — | — | 0.73 | " | 0.03 | 4.8 |
| " | 11 | 10.0 | 0.82 | — | 0.003 | — | — | " | 0.11 | 6.6 |
| " | 12 | 10.1 | 1.50 | — | 0.01 | — | — | " | 0.03 | 3.5 |
| " | 13 | 10.3 | 1.51 | — | 0.15 | — | 0.69 | " | <0.02 | 3.4 |
| " | 14 | 9.7 | 2.03 | — | 0.02 | — | 0.71 | " | <0.02 | 3.1 |
| " | 15 | 10.0 | 1.54 | — | — | 0.003 | — | " | 0.12 | 5.5 |
| " | 16 | 9.9 | 1.51 | — | — | 0.05 | 0.74 | " | <0.02 | 3.1 |
| " | 17 | 10.2 | 1.50 | 0.14 | 0.01 | — | — | " | <0.02 | 3.6 |
| " | 18 | 10.3 | 1.49 | 0.01 | 0.003 | 0.003 | — | " | 0.09 | 4.1 |
| " | 19 | 21.1 | 0.79 | 0.11 | — | — | 0.77 | " | <0.02 | 3.6 |
| " | 20 | 20.5 | 1.47 | 0.01 | — | — | — | " | 0.10 | 4.5 |
| " | 21 | 20.3 | 0.80 | — | 0.01 | — | — | " | <0.02 | 3.3 |
| " | 22 | 21.0 | 1.50 | — | 0.12 | — | 0.70 | " | <0.02 | 3.7 |
| " | 23 | 20.1 | 0.85 | — | — | 0.01 | 0.73 | " | <0.02 | 3.6 |
| " | 24 | 30.5 | 0.45 | 0.12 | — | — | 0.72 | " | <0.02 | 3.1 |
| " | 25 | 31.3 | 0.50 | — | 0.01 | — | 0.65 | " | <0.02 | 2.7 |
| " | 26 | 31.0 | 2.05 | — | 0.02 | — | — | " | <0.02 | 3.0 |
| " | 27 | 30.2 | 0.51 | — | — | 0.01 | — | " | <0.02 | 3.3 |
| " | 28 | 30.9 | 0.50 | 0.10 | 0.01 | — | — | " | <0.02 | 2.9 |
| " | 29 | 31.0 | 2.01 | 0.01 | 0.003 | 0.003 | 0.70 | " | 0.05 | 3.5 |
| Comparative alloy | 30 | 4.1 | 1.50 | 0.55 | — | — | 0.71 | " | 0.38 | 12.4 |
| " | 31 | 10.9 | 0.19 | 1.01 | — | — | 0.74 | " | 0.31 | 20.8 |
| " | 32 | 9.5 | 0.18 | — | 0.17 | — | 0.70 | " | 0.47 | 23.7 |
| " | 33 | 10.1 | 3.01 | 0.50 | — | — | 0.67 | " | 0.58 | 9.9 |
| " | 34 | 9.8 | 1.55 | — | 0.001 | — | 0.72 | " | 0.35 | 10.1 |
| " | 35 | 10.3 | 1.51 | — | — | 0.001 | 0.73 | " | 0.33 | 9.2 |
| " | 36 | 10.0 | 1.52 | 0.005 | — | — | — | " | 0.38 | 9.6 |
| Conventional alloy | 37 | 5.3 | 1.50 | — | — | — | 0.69 | " | 1.0 | 17.6 |
| " | 38 | 10.1 | 1.51 | — | — | — | 0.72 | " | 0.45 | 10.5 |
| " | 39 | 20.7 | 0.82 | — | — | — | 0.70 | " | 0.23 | 8.1 |
| " | 40 | 31.5 | 0.50 | — | — | — | 0.73 | " | 0.21 | 7.4 |

TABLE 2

| Alloy | No | Composition (wt %) Ni | Fe | In | Pd | Pt | Mn | Cu | Maximum corrosion depth(mm) | Weight loss (mg/cm2) |
|---|---|---|---|---|---|---|---|---|---|---|
| Invented alloy | 41 | 4.9 | 1.33 | 0.01 | — | — | — | Balance | 0.11 | 5.1 |
| " | 42 | 5.1 | 1.81 | 0.95 | — | — | 0.71 | " | 0.04 | 3.9 |
| " | 43 | 4.8 | 1.78 | — | 0.20 | — | — | " | 0.04 | 3.1 |
| " | 44 | 5.0 | 1.51 | — | — | 0.005 | — | " | 0.10 | 4.5 |
| " | 45 | 10.2 | 0.83 | 0.01 | — | — | 0.75 | " | 0.09 | 5.3 |
| " | 46 | 9.8 | 1.54 | 0.12 | — | — | — | " | <0.02 | 2.7 |
| " | 47 | 10.1 | 1.50 | — | 0.01 | — | — | " | <0.02 | 2.4 |
| " | 48 | 9.7 | 2.03 | — | 0.02 | — | 0.71 | " | <0.02 | 2.1 |
| " | 49 | 10.0 | 1.54 | — | — | 0.03 | — | " | 0.05 | 2.9 |
| " | 50 | 20.5 | 1.47 | 0.01 | — | — | — | " | 0.03 | 2.5 |
| " | 51 | 20.3 | 0.80 | — | 0.01 | — | — | " | <0.02 | 3.4 |
| " | 52 | 21.0 | 1.50 | — | 0.12 | — | 0.70 | " | <0.02 | 2.7 |
| " | 53 | 31.3 | 0.50 | — | 0.01 | — | 0.65 | " | <0.02 | 3.0 |
| " | 54 | 31.0 | 2.05 | — | 0.02 | — | — | " | <0.02 | 2.7 |
| " | 55 | 30.9 | 0.50 | 0.10 | 0.01 | — | — | " | <0.02 | 3.0 |
| Conventional alloy | 56 | 5.3 | 1.50 | — | — | — | 0.69 | " | 0.43 | 11.2 |
| " | 57 | 10.1 | 1.51 | — | — | — | 0.72 | " | 0.18 | 5.8 |
| " | 58 | 20.7 | 0.82 | — | — | — | 0.70 | " | 0.25 | 7.6 |
| " | 59 | 31.5 | 0.50 | — | — | — | 0.73 | " | 0.17 | 7.5 |

Quenching by water from 900° C.

What is claimed is:

1. An anticorrosion copper alloy essentially consisting of 4.5–32 wt % of Ni and 0.3–2.5 wt % of Fe shown as coordinates within the shaded area of FIG. 1; either one or more elements selected from 0.01–1.0 wt % of In, 0.003–0.2 wt % of Pd and 0.003–0.1 wt % of Pt; and the remainder Cu and normal impurities.

2. An anticorrosion copper alloy as defined in claim 1 wherein said copper alloy further contains not more than 1.0 wt % of Mn therein.

3. An anticorrosion copper alloy essentially consisting of 7.5–15 wt % of Ni, 1.0–2.0 wt % of Fe, one or more elements selected from 0.1–1.0 wt % of In, 0.01–0.2 wt % of Pd and 0.01–0.1 wt % of Pt, and the remainder Cu and normal impurities.

4. An anticorrosion copper alloy as defined in claim 3 wherein said copper alloy further contains not more than 1.0 wt % of Mn therein.

5. An anticorrosion copper alloy essentially consisting of 28–32 wt % of Ni, 0.4–1.0 wt % of Fe, one or more elements selected from 0.1–1.0 wt % of In, 0.01–0.2 wt % of Pd and 0.01–0.1 wt % of Pt, and the remainder Cu and normal impurities.

6. An anticorrosion copper alloy as defined in claim 5 wherein said copper alloy further contains not more than 1.0 wt % of Mn therein.

7. An anticorrosion copper alloy essentially consisting of 4.5–22 wt % of Ni, 1.3–2.5 wt % of Fe, one or more elements selected from 0.1–1.0 wt % of In, 0.01–0.2 wt % of Pd and 0.01–0.1 wt % of Pt, and the remainder Cu and normal impurities, said Fe being kept in a state of solid solution in a matrix of said copper alloy.

8. An anticorrosion copper alloy as defined in claim 7 wherein said copper alloy further contains not more than 1.0 wt % of Mn.

9. An anticorrosion copper alloy as defined in claim 7 wherein the amount of Ni is 7.5–15 wt %.

10. An anticorrosion copper alloy defined in claim 8 wherein the amount of Ni is 7.5–15 wt %.

* * * * *